US007089863B1

(12) United States Patent
Dindl

(10) Patent No.: US 7,089,863 B1
(45) Date of Patent: Aug. 15, 2006

(54) NON-LETHAL CARTRIDGES WITH DENSE POWDER BALLAST

(75) Inventor: Frank J. Dindl, Newton, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/250,187

(22) Filed: Jun. 11, 2003

Related U.S. Application Data

(60) Provisional application No. 60/387,496, filed on Jun. 11, 2002.

(51) Int. Cl.
*F42B 8/14* (2006.01)

(52) U.S. Cl. ..... 102/444; 102/502; 102/524; 102/529

(58) Field of Classification Search ..... 102/444, 102/458, 502, 513, 532, 430, 445, 446, 447
See application file for complete search history.

(56) References Cited

U.S. PATENT DOCUMENTS

| | | | | | |
|---|---|---|---|---|---|
| 1,624,649 | A * | 4/1927 | Des Allimes | ..... | 102/462 |
| 2,851,991 | A * | 9/1958 | Rinck | ..... | 119/719 |
| 3,058,420 | A * | 10/1962 | Tanner et al. | ..... | 102/439 |
| 3,060,854 | A * | 10/1962 | Maretti | ..... | 102/352 |
| 3,188,956 | A * | 6/1965 | Stuart | ..... | 102/461 |
| 3,983,817 | A * | 10/1976 | Tucker | ..... | 102/513 |
| 4,043,267 | A * | 8/1977 | Hayashi | ..... | 102/439 |
| 4,063,511 | A * | 12/1977 | Bullard | ..... | 102/436 |
| 4,733,613 | A * | 3/1988 | Bilsbury et al. | ..... | 102/532 |
| 4,895,076 | A * | 1/1990 | Looger et al. | ..... | 102/439 |
| 5,121,692 | A * | 6/1992 | DiCarlo | ..... | 102/439 |
| 5,225,628 | A * | 7/1993 | Heiny | ..... | 102/438 |
| 5,361,701 | A * | 11/1994 | Stevens | ..... | 102/450 |
| 5,375,529 | A * | 12/1994 | Knight et al. | ..... | 102/513 |
| 5,408,931 | A * | 4/1995 | Tallman | ..... | 102/439 |
| 5,450,795 | A * | 9/1995 | Adelman | ..... | 102/444 |
| 5,565,649 | A * | 10/1996 | Tougeron et al. | ..... | 102/502 |
| 5,824,944 | A * | 10/1998 | Dippold et al. | ..... | 102/439 |
| 5,880,398 | A * | 3/1999 | Crilly et al. | ..... | 102/501 |
| 6,283,037 | B1 * | 9/2001 | Sclafani | ..... | 102/502 |
| 6,393,992 | B1 * | 5/2002 | Vasel et al. | ..... | 102/502 |
| 6,505,561 | B1 * | 1/2003 | Dietrich | ..... | 102/489 |
| 6,722,283 | B1 * | 4/2004 | Dindl et al. | ..... | 102/489 |

FOREIGN PATENT DOCUMENTS

DE 2516579 * 10/1976

* cited by examiner

*Primary Examiner*—Peter M. Poon
*Assistant Examiner*—David J. Parsley
(74) *Attorney, Agent, or Firm*—Robert Charles Beam; John F. Moran

(57) ABSTRACT

A non-lethal cartridge having sufficient discharge energy for use, without modification, in conventional firearms. When used with a firearm with a rifled barrel, the cartridge comprises a non-lethal projectile having a grooved outer surface and a dense powder ballast. Upon discharge, the dense powder ballast is dispersed. When used with a smooth bore firearm, the cartridge also comprises a cylindrical casing having rifling grooves on the inner surface thereof. These grooves will impose a spin on a projectile fired from the cartridge casing. The dense powder ballast will provide sufficient initial inertial mass to permit proper functioning of the firearm, but disperses and dissipates a portion of the discharge energy, simulating the recoil impulse and permitting the non-lethal projectile to simulate the trajectory of standard ammunition.

5 Claims, 2 Drawing Sheets

NON-LETHAL CARTRIDGES WITH DENSE POWDER BALLAST

CROSS REFERENCE TO RELATED APPLICATIONS

This application claims benefit under 35 USC 119(e) of provisional application 60/387,496, filed Jun. 11, 2002, the entire file wrapper contents of which provisional application are herein incorporated by reference as though fully set forth at length.

FEDERAL RESEARCH STATEMENT

The invention described herein may be made, used, or licensed by or for the United States Government for Government purposes without the payment of any royalties thereon or therefore.

BACKGROUND OF INVENTION

Non-lethal ammunition typically launches a projectile with a kinetic energy that will produce non-lethal effects upon target impact. Existing semi-automatic and automatic weapons such as semi-automatic shotguns are designed to fire projectiles with kinetic energies far greater than non-lethal projectiles of the same caliber. The weapon operating systems are designed to function with projectiles which have a specific minimum ammunition impulse. There is a great and still unsatisfied need for firing non-lethal ammunition from conventional weapons such as semi-automatic shotguns. However, the recoil impulse and trajectory of the non-lethal ammunition needs to be compatible with the standard combat ammunition recoil impulse and trajectory to fully utilize the weapon's capabilities.

1. Field of the Invention

The present invention relates to non-lethal cartridges having sufficient discharge energy for use, without modification, in conventional In particular, the present invention relates to a non-lethal cartridges having sufficient discharge energy for use, without modification, in conventional firearms with a rifled barrel, which non-lethal cartridge comprises: a non-lethal projectile having a grooved outer surface which will mate with the rifling of said firearm and impart a spin to said projectile when traversing the barrel thereof; a dense powder ballast contained within a payload cup which payload cup will open upon discharge, causing a dispersion of said dense powder ballast; and wherein said dense powder ballast provides sufficient initial inertial mass to permit proper functioning of the firearm, but disperses and dissipates a portion of the discharge energy, simulating the recoil impulse and permitting said non-lethal projectile to simulate the trajectory of standard ammunition.

In another embodiment, the present invention relates to a non-lethal cartridge having sufficient discharge energy for use, without modification, in conventional firearms with a smooth bore, which non-lethal cartridge comprises: a cartridge casing comprising a cylindrical portion having an inner surface thereon, and rifling provisions formed on the inner surface of the cylindrical portion for imposing spin on a projectile fired from the cartridge casing; a non-lethal projectile disposed within said cartridge casing, said non-lethal projectile having a grooved outer surface which will mate with the rifling of said cartridge casing and impart a spin to said projectile when fired from said cartridge casing; a dense powder ballast contained within a payload cup which payload cup will open upon discharge, causing a dispersion of said dense powder ballast; and wherein said dense powder ballast provides sufficient initial inertial mass to permit proper functioning of the firearm, but disperses and dissipates a portion of the discharge energy, simulating the recoil impulse and permitting said non-lethal projectile to simulate the trajectory of standard ammunition.

2. Description of Related Art

BRIEF SUMMARY OF THE INVENTION

Objects of the Invention

It is an object of the present invention to provide a non-lethal cartridge having sufficient discharge energy for use, without modification, in conventional firearms.

The other objects, features and advantages of the present invention will become more apparent in light of the following detailed description of the preferred embodiment thereof.

SUMMARY OF INVENTION

According to the present invention, there is provided a non-lethal cartridge having sufficient discharge energy for use, without modification, in conventional firearms with a rifled barrel, which non-lethal cartridge comprises: a non-lethal projectile having a grooved outer surface which will mate with the rifling of said firearm and impart a spin to said projectile when traversing the barrel thereof; a dense powder ballast contained within a payload cup which payload cup will open upon discharge, causing a dispersion of said dense powder ballast; and wherein said dense powder ballast provides sufficient initial inertial mass to permit proper functioning of the firearm, but disperses and dissipates a portion of the discharge energy, simulating the recoil impulse and permitting said non-lethal projectile to simulate the trajectory of standard ammunition.

According to another embodiment of the present invention, there is provided a non-lethal cartridge having sufficient discharge energy for use, without modification, in conventional firearms with a smooth bore, which non-lethal cartridge comprises: a cartridge casing comprising a cylindrical portion having an inner surface thereon, and rifling provisions formed on the inner surface of the cylindrical portion for imposing spin on a projectile fired from the cartridge casing; a non-lethal projectile disposed within said cartridge casing, said non-lethal projectile having a grooved outer surface which will mate with the rifling of said cartridge casing and impart a spin to said projectile when fired from said cartridge casing; a dense powder ballast contained within a payload cup which payload cup will open upon discharge, causing a dispersion of said dense powder ballast; and wherein said dense powder ballast provides sufficient initial inertial mass to permit proper functioning of the firearm, but disperses and dissipates a portion of the discharge energy, simulating the recoil impulse and permitting said non-lethal projectile to simulate the trajectory of standard ammunition.

BRIEF DESCRIPTION OF DRAWINGS

The features of the present invention and the manner of attaining them will become apparent, and the invention itself will be understood by reference to the following description and the accompanying drawings. In these drawings, like numerals refer to the same or similar elements. The sizes of the different components in the figures might not be in exact proportion, and are shown for visual clarity and for the purpose of explanation.

DETAILED DESCRIPTION

One feature of the present invention is to satisfy the long felt need to provide non-lethal ammunition with a recoil impulse and trajectory that is compatible with convention combat ammunition. The present invention accomplishes this by using a projectile and dense powder ballast whose combined mass, muzzle velocity and trajectory combine to achieve weapon powering and provide compatibility with weapon sighting systems. The present invention can be used in rifled weapons and smooth-bore weapons. In smooth-bore weapons, a rifled cartridge case, such as the one taught in my co-pending U.S. patent application Ser. No. 10/249,797, filed May 8, 2003, the teachings of which are hereby incorporated by reference as completely as if they were fully set forth herein, can be employed. Such a cartridge case will impart spin to the non-lethal projectile. The dense power ballast increases the total effective projectile mass to a sufficient level to power the weapon operation mechanism while launching the non-lethal projectile at the desired non-lethal velocity.

The dense powder ballast for use in the present invention may be selected from one or more of a number of relatively dense materials which will not agglomerate under the accelerations inherent in the discharge of firearms. Some materials which have been shown to be useful in this regard are powdered tungsten, powdered iron, and sand.

The dense powder ballast is contained within a payload cup, similar to wadding in a shotgun shell, which opens upon discharge to disperse the dense powder ballast. This allows the dense powder to be dispersed and decelerated to a non-lethal velocity that is also eye safe at the target.

The projectile and dense powder ballast payload configurations allows launching non-lethal projectiles from semi-automatic and automatic weapons, such as the envisioned 20 mm Objective Individual Combat Weapon, the envisioned 25 mm Objective Crew Served Weapon, the 40 mm MK19 grenade launcher, 12 gauge semi-automatic shotguns, and other semi-automatic and automatic weapons of other calibers while producing non-lethal effects at the target. The projectile configuration allows firing conventional non-lethal projectiles while powering semi-automatic and automatic weapons without the need to modify the weapon or sighting system.

The embodiments described herein are included for the purposes of illustration, and are not intended to be exhaustive. Rather, these embodiments can be modified within the scope of the invention. Other modifications may be made when implementing the invention for a particular application.

Figure 1:
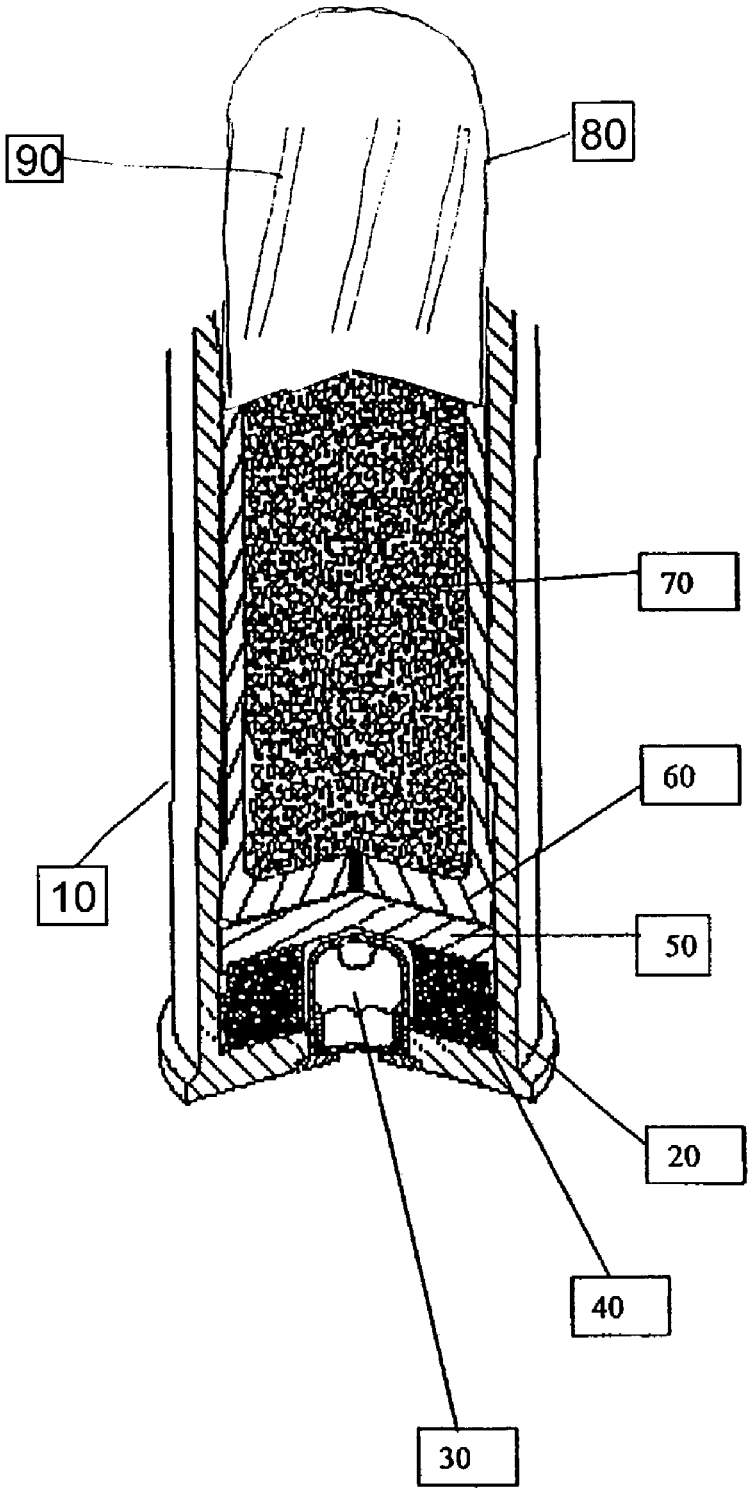
FIG. 1 shows a cut-away version of one embodiment of the present invention.

FIG. 1 shows a cut-away version of one embodiment of the present invention.

According to this embodiment of the present invention, there is provided a non-lethal cartridge 10 having sufficient discharge energy for use, without modification, in conventional firearms. This embodiment is intended for use in a firearm with a rifled barrel. In this embodiment, the non-lethal cartridge 10 comprises a non-lethal projectile 80 having a grooved outer surface 90 which will mate with the rifling of the firearm and impart a spin to the projectile 80 when traversing the barrel thereof.

The non-lethal cartridge 10 also comprises a dense powder ballast 70 comprising a compressed solid contained within a payload cup 60 which will open upon discharge, permitting dispersal of the dense powder ballast 70. A typical cartridge 10 will also comprise a primer 30, a propellant charge 40, and a wad 50.

In such a construction, the dense powder ballast 70 provides sufficient initial inertial mass to permit proper functioning of the firearm, but rapidly disperses and dissipates a portion of the discharge energy upon exiting the barrel of the firearm. This permits the non-lethal cartridge 10 of the present invention to simulate the recoil impulse of standard ammunition and, at the same time, permit the non-lethal projectile 80 to simulate the trajectory of standard ammunition.

Figure 2:
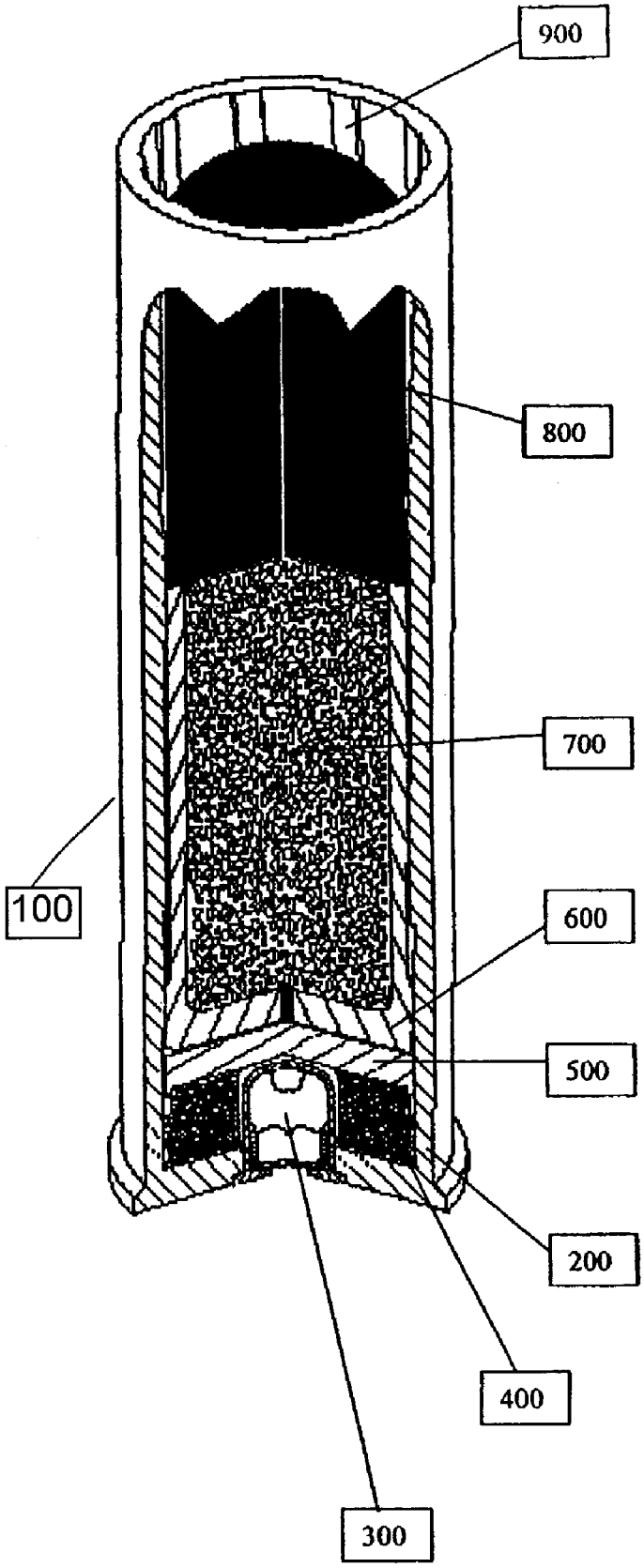
FIG. 2 shows a cut-away version of another embodiment of the present invention.

FIG. 2 shows a cut-away version of another embodiment of the present invention.

According to this embodiment of the present invention, there is provided a non-lethal cartridge 100 having sufficient discharge energy for use, without modification, in conventional firearms. This embodiment is intended for use in a firearm with a smooth bore, such as a conventional shotgun. In this embodiment, the non-lethal cartridge 100 comprises a cartridge casing 900 comprising a cylindrical portion having an inner surface thereon. These rifling provisions formed on the inner surface of the cylindrical portion of the cartridge casing 900 are for imposing spin on a projectile fired from the cartridge casing. In this regard, a rifled cartridge case, such as the one taught in my co-pending U.S. patent application Ser. No. 10/249,797, filed May 8, 2003, the teachings of which are hereby incorporated by reference as completely as if they were fully set forth herein, can be employed.

Like the embodiment of FIG. 1, the cartridge case 100 of FIG. 2 further comprises a non-lethal projectile 800 disposed within the cartridge casing 900. This non-lethal projectile 800 is grooved upon its outer surface, and this grooving will mate with the rifling of the cartridge casing 900 and impart a spin to the projectile 800 when fired from said cartridge casing 900.

Also disposed within the cartridge casing 900 is a dense powder ballast 700 contained within a payload cup 600 which will open upon discharge, permitting dispersal of the dense powder ballast 700. A typical cartridge 100 will also comprise a primer 300, a propellant charge 400, and a wad 500.

In such a construction, the dense powder ballast 700 provides sufficient initial inertial mass to permit proper functioning of the firearm, but rapidly disperses and dissipates a portion of the discharge energy upon exiting the barrel of the firearm. This permits the non-lethal cartridge 100 of the present invention to simulate the recoil impulse of standard ammunition and, at the same time, permit the non-lethal projectile 800 to simulate the trajectory of standard ammunition.

Other features, advantages, and specific embodiments of this invention will become readily apparent to those exercising ordinary skill in the art after reading the foregoing disclosures. These specific embodiments are within the scope of the claimed subject matter unless otherwise expressly indicated to the contrary. Moreover, while specific embodiments of this invention have been described in considerable detail, variations and modifications of these embodiments can be effected without departing from the spirit and scope of this invention as disclosed and claimed.

What is claimed is:

1. A non-lethal cartridge having sufficient discharge energy for use, without modification, in conventional firearms with a rifled barrel, which non-lethal cartridge comprises:

a non-lethal projectile having a grooved outer surface which will mate with the rifling of said firearm and impart a spin to said projectile when traversing the barrel thereof;

a dense powder ballast contained within a payload cup which payload cup will open upon discharge, causing a dispersion of said dense powder ballast; and wherein said dense powder ballast provides sufficient initial inertial mass to permit proper functioning of the firearm, but disperses and dissipates a portion of the discharge energy simulating the recoil impulse and permitting said non-lethal projectile to simulate the trajectory of standard ammunition, and wherein the dense powder ballast is a dense material which will not agglomerate under the acceleration inherent in the discharge of a firearm.

2. The non-lethal cartridge of claim 1, wherein the dense powder ballast comprises, at least in part, a material selected from powdered tungsten, powdered iron and sand.

3. The non-lethal cartridge of claim 1, wherein the dense powder ballast comprises, at least in part, powdered tungsten.

4. The non-lethal cartridge of claim 1, wherein the dense powder ballast comprises, at least in part, powdered iron.

5. The non-lethal cartridge of claim 1, wherein the dense powder ballast comprises, at least in part, sand.

* * * * *